US009962587B2

(12) United States Patent
Siepmann

(10) Patent No.: US 9,962,587 B2
(45) **Date of Patent: *May 8, 2018**

(54) CONVERTIBLE TIERED GAME SYSTEM

(71) Applicant: Scott Siepmann, Scottsdale, AZ (US)

(72) Inventor: Scott Siepmann, Scottsdale, AZ (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/256,075

(22) Filed: Sep. 2, 2016

(65) Prior Publication Data

US 2017/0319928 A1 Nov. 9, 2017

Related U.S. Application Data

(63) Continuation-in-part of application No. 29/573,512, filed on Aug. 5, 2016, which is a continuation-in-part of application No. 29/573,511, filed on Aug. 5, 2016, which is a continuation-in-part of application No. 29/563,589, filed on May 5, 2016, which is a continuation-in-part of application No. 15/147,840, filed on May 5, 2016.

(51) Int. Cl.

| | |
|---|---|
| ***A63B 63/00*** | (2006.01) |
| ***A63B 67/06*** | (2006.01) |
| ***A63F 7/22*** | (2006.01) |
| *A63F 3/00* | (2006.01) |
| *A63B 67/00* | (2006.01) |

(52) U.S. Cl.

CPC ..... *A63B 67/06* (2013.01); *A63F 7/22* (2013.01); *A63B 63/00* (2013.01); *A63B 67/00* (2013.01); *A63F 3/00214* (2013.01); *A63F 2250/024* (2013.01); *A63F 2250/04* (2013.01)

(58) Field of Classification Search

CPC ..... A63F 3/00214; A63F 2250/024; A63B 67/06; A63B 67/002; A63B 67/007

USPC ..... 273/398–402, 241, 261, 282.1, 282.3

See application file for complete search history.

(56) References Cited

U.S. PATENT DOCUMENTS

| | | | | | |
|---|---|---|---|---|---|
| 3,917,273 | A | * | 11/1975 | Blakewood, III | A63F 3/00176 273/261 |
| 4,082,283 | A | * | 4/1978 | La Ferla | A63F 3/00214 273/153 J |
| 4,179,127 | A | * | 12/1979 | Goodman | A63F 3/00214 273/241 |
| 4,744,566 | A | * | 5/1988 | Malavazos | A63F 7/305 273/138.4 |
| 4,772,027 | A | * | 9/1988 | Martel | A63F 3/00643 273/237 |

(Continued)

*Primary Examiner* — Mark Graham

(74) *Attorney, Agent, or Firm* — Michelle L. Gross, P.C.

(57) ABSTRACT

A convertible tiered game system comprising a plurality of tiered platforms, each tiered platform having at least one of a width and a length that is greater than any higher tiered platform, a plurality of tiered overlays configured to be seated upon each tiered platform among the plurality of tiered platforms, at least three of the tiered overlays comprising a center opening and having at least one of a width and a length that is greater than any higher tiered overlay, and a plurality of beverage container placement markers located on at least one of a tiered platform and a tiered overlay. The system may further comprise a lowest tiered overlay configured to rest on a same surface as the lowest tiered platform. The tiered overlays may comprise a lip extending downward along a vertical side wall of a tiered platform on which the tiered overlay is seated.

13 Claims, 17 Drawing Sheets

(56) References Cited

U.S. PATENT DOCUMENTS

| | | | | | |
|---|---|---|---|---|---|
| 5,004,245 | A * | 4/1991 | Schumacher | A63F 3/0023 | 273/241 |
| 5,660,388 | A * | 8/1997 | Benn | A63F 3/00214 | 273/241 |
| 5,662,329 | A * | 9/1997 | Nason | A63F 3/00214 | 273/261 |
| 5,833,240 | A * | 11/1998 | Barbour | A63F 3/00574 | 273/282.1 |
| 6,279,907 | B1 * | 8/2001 | Hullinger | A63F 3/00214 | 273/241 |
| 6,581,933 | B1 * | 6/2003 | Zivan | A63F 3/00214 | 273/148 A |
| 8,353,515 | B2 * | 1/2013 | Cheng | A63F 3/00214 | 273/241 |
| 8,651,492 | B1 * | 2/2014 | Cappuccio | A63B 67/002 | 273/317 |
| 2004/0135314 | A1 * | 7/2004 | Peterson | A63F 3/00176 | 273/241 |
| 2007/0187893 | A1 * | 8/2007 | Brown | A63F 3/00094 | 273/241 |
| 2009/0230625 | A1 * | 9/2009 | Clutterbuck | A63F 3/02 | 273/287 |
| 2010/0044964 | A1 * | 2/2010 | Constantine | A63B 63/08 | 273/378 |
| 2012/0169012 | A1 * | 7/2012 | Parker | A63B 67/002 | 273/400 |
| 2015/0069708 | A1 * | 3/2015 | Mashburn | A63B 67/06 | 273/400 |
| 2016/0038809 | A1 * | 2/2016 | Rockwell | A63B 67/06 | 273/401 |

* cited by examiner

CONVERTIBLE TIERED GAME SYSTEM

CROSS REFERENCE TO RELATED APPLICATIONS

This application is a continuation in part of and claims priority to U.S. application Ser. No. 29/573,512 entitled "Beverage Pong Game Board" filed on Aug. 5, 2016 which is a continuation in part of U.S. application Ser. No. 29/573,511 entitled "Convertible Tiered Game System" filed on Aug. 5, 2015 which is a continuation in part of U.S. application Ser. No. 29/563,589 entitled "Tiered Beverage Pong Game System" filed on May 5, 2016 which is a continuation in part of U.S. application Ser. No. 15/147,840 entitled "Tiered Beverage Pong Game System" filed on May 5, 2016.

BACKGROUND

1. Technical Field

Aspects of this document relate generally to beverage consumption games for entertainment purposes.

2. Background Art

Any discussion of the related art throughout the specification should in no way be considered as an admission that such related art is widely known or forms part of common general knowledge in the field.

Beer pong, also known as Beirut, is a popular party game, particularly on college campuses. While the rules of the game may vary slightly, generally there are two teams of players at opposite sides of a table with a plurality of cups arranged in a formation similar to that of bowling pins at a bowling alley. The players take turns tossing or bouncing a ping pong ball with the object of having the ball land into a cup at their opponents' end of the table at which time, the opponent must consume the beverage, which is typically beer or another alcoholic beverage.

SUMMARY

Implementations of a convertible tiered game system may comprise a plurality of tiered platforms, each tiered platform having at least one of a width and a length that is greater than any higher tiered platform, a plurality of tiered overlays configured to be seated upon each tiered platform among the plurality of tiered platforms, at least three of the tiered overlays comprising a center opening and having at least one of a width and a length that is greater than any higher tiered overlay and a plurality of beverage container placement markers located on at least one of a tiered platform and a tiered overlay.

Some embodiments may comprise one or more of the following elements. The center opening in the at least three tiered overlays may be configured such that a next highest tiered platform is allowed to pass through center opening. The at least three tiered overlays comprise a width that is greater than a width of the tiered platform on which the tiered overlay is seated and a length that is greater than a length of the tiered platform on which the tiered overlay is seated. The convertible tiered game system may further comprise a lowest tiered overlay comprising a center opening configured to pass a lowest tiered platform therethrough. The lowest tiered overlay may be configured to rest on a surface on which the lowest tiered platform rests. The convertible tiered game system may further comprise a highest tiered overlay configured to be seated upon a highest tiered platform. At least one tiered overlay among the plurality of tiered overlays may comprise a lip that overhangs a vertical side of the tiered platform on which the at least one tiered overlay is seated. Each tiered overlay that comprises an opening may comprise a plurality of beverage container placement markers. Each tiered overlay comprising an opening may comprise one more beverage container placement marker along a width of a lower tiered overlay than the tiered overlay comprising an opening immediately above the lower tiered overlay. Each tiered platform except for a highest tiered platform may comprise a central opening configured such that each next lower tiered platform may be placed on top of each next higher tiered platform to create a collapsed and nested tiered platform structure having a vertical height that is substantially equal to a height of a vertical side wall of a lowest tiered platform.

Implementations of a convertible tiered game system may comprise a plurality of tiered platforms, each tiered platform having at least one of a width and a length that is greater than any higher tiered platform, a plurality of tiered overlays each having at least one of a width and a length that is greater than any higher tiered overlay, each tiered overlay configured to be seated upon a tiered platform, the plurality of tiered overlays comprising at least three tiered overlays comprising a center opening, and a highest tiered overlay comprising a continuous substantially planar surface; wherein each tiered overlay has at least one of a width and a length that is greater than any higher tiered overlay and each tiered overlay is configured to be seated upon a tiered platform.

Some embodiments may comprise one or more of the following elements. Each tiered overlay may comprise a lip proximal to a perimeter of the tiered overlay that extends downward along a vertical side of the tiered platform upon which the tiered overlay is seated. The plurality of tiered overlays may further comprise a lowest tiered overlay comprising a center opening configured to allow a lowest tiered platform to pass therethrough. The convertible tiered game system may further comprise a plurality of beverage container placement markers located on an upper surface of at least one tiered overlay. A second highest tiered overlay may comprise a single beverage container placement marker on an upper surface of each of four sides of the second highest tiered overlay, a third highest tiered overlay may comprise two beverage container placement markers on an upper surface of each of four sides of the third highest tiered overlay, and a fourth highest tiered overlay may comprise three beverage container placement markers on an upper surface of each of four sides of the fourth highest tiered overlay. The convertible tiered game system may further comprise a fifth highest tiered overlay comprising four beverage container placement markers on an upper surface of each of four sides of the fifth highest tiered overlay.

Implementations of a method of using a convertible tiered game system may comprising when a plurality of tiered overlays each having at least one of a width and a length that is greater than any higher tiered overlay is seated on a plurality of tiered platforms, each tiered platform having at least one of a width and a length that is greater than any higher tiered platform: a) consuming, by a first player, a beverage within a first beverage container corresponding to a first beverage container placement marker that is located on an upper surface of a lowest tiered overlay of the first player's side of the convertible tiered game system; b) placing the first empty beverage container right side up on the lowest tiered overlay of the first player's side of the convertible tiered game system such that a portion of the first empty beverage container extends over an outer perimeter of the lowest tiered overlay; and c) attempting, by the first player, to flip the first empty beverage container onto a next higher tiered overlay.

Some embodiments may comprise one or more of the following elements. The method may further comprise repeating steps a) through c) by the first player if the first empty beverage container lands on the next higher tiered overlay in an upside down position and returning the first empty beverage container to the first player's lowest tiered overlay and executing by a second player steps a) through c) on the second player's side of the board if the first empty beverage container fails to land on the next higher tiered overlay in the upside down position. The method may further comprise when each beverage container on the lowest tiered overlay of the first player has been successfully flipped to the next higher tiered overlay and has landed in an upside down position, consuming, by the first player, a beverage within a beverage container corresponding to a beverage container maker that is located on an upper surface of the next higher tiered overlay of the first player's side of the convertible tiered game system, placing the empty beverage container right side up on the next higher tiered overlay of the first player's side of the convertible tiered game system such that a portion of the empty beverage container extends over an outer perimeter of the next higher tiered overlay and attempting to flip the empty beverage container onto a subsequently higher tiered overlay. The method may further comprise winning the game by a player when all beverage containers on the player's side of the convertible tiered game system are cleared from the player's tiered overlays and the player's last beverage container has been successfully flipped and has landed in an upside down position on a highest tiered overlay.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventor is fully aware that he can be his own lexicographer if desired. The inventor expressly elects, as his own lexicographer, to use only the plain and ordinary meaning of terms in the specification and claims unless he clearly states otherwise and then further, expressly sets forth the "special" definition of that term and explains how it differs from the plain and ordinary meaning. Absent such clear statements of intent to apply a "special" definition, it is the inventor's intent and desire that the simple, plain and ordinary meaning to the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of post-AIA 35 U.S.C. § 112(f). Thus, the use of the words "function," "means" or "step" in the Detailed Description, Drawings, or Claims is not intended to somehow indicate a desire to invoke the special provisions of post-AIA 35 U.S.C. § 112(f), to define the invention. To the contrary, if the provisions of post-AIA 35 U.S.C. § 112(f) are sought to be invoked to define the claimed disclosure, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of post-AIA 35 U.S.C. § 112(f). Moreover, even if the provisions of post-AIA 35 U.S.C. § 112(f) are invoked to define the claimed disclosure, it is intended that the disclosure not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

Unless otherwise defined, all technical and scientific terms used herein have the same meaning as commonly understood by one of ordinary skill in the art to which this invention belongs. Although methods and materials similar to or equivalent to those described herein can be used in the practice or testing of the tiered beverage pong game system, suitable methods and materials are described above. All publications, patent applications, patents, and other references mentioned herein are incorporated by reference in their entirety to the extent allowed by applicable law and regulations. The tiered beverage pong game system may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact. As used herein, phrases such as "make contact with," "coupled to," "touch," "interface with" and "engage" may be used interchangeably.

The features, structures, or characteristics of the invention described throughout this specification may be combined in any suitable manner in one or more embodiments. For example, the usage of the phrases "exemplary embodiments", "some embodiments" or other similar language refers to the fact that a particular feature, structure, or characteristic described in connection with the embodiment may be included in at least one embodiment of the present invention. Thus, appearances of the phrases "exemplary embodiments", "in some embodiments", "in other embodiments" or other similar language, throughout this specification do not necessarily all refer to the same group of embodiments, and the described features, structures, or characteristics may be combined in any suitable manner in one or more embodiments.

Figure 1:
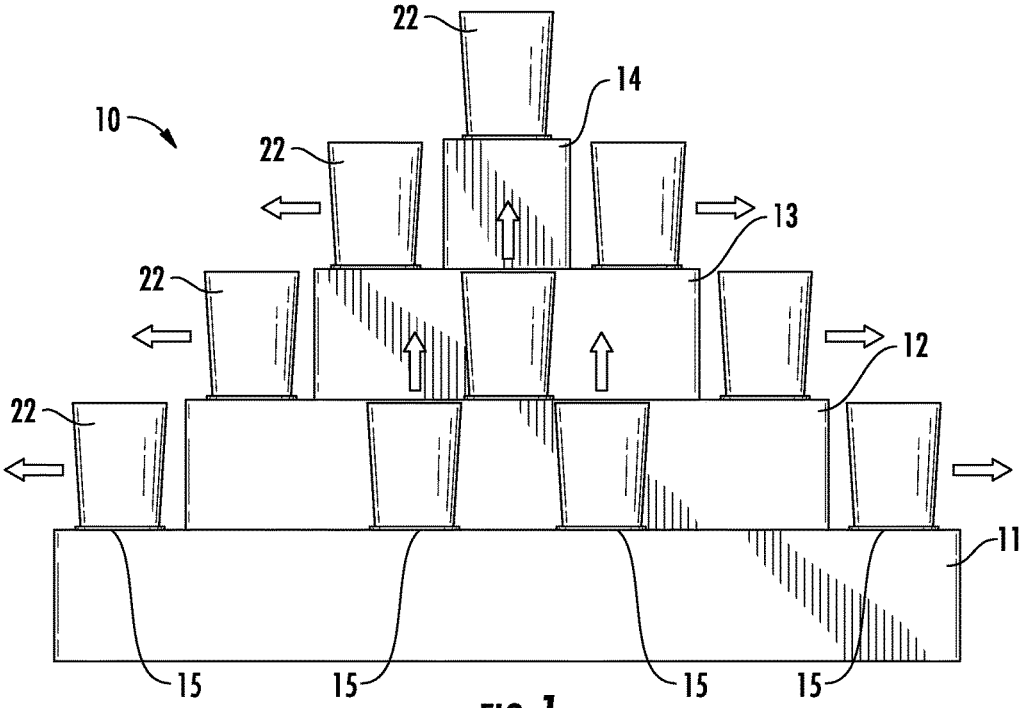
FIG. 1 provides an example of a tiered beverage pong game system indicating with arrows indicating a direction in which beverage containers are passed in accordance with an exemplary embodiment of the system.

FIG. 1 provides an exemplary depiction of a beverage pong game system having a structure of tiered platforms of decreasing size which form a quasi-pyramid shape. While it is contemplated that embodiments of the system may comprise any number of tiered platforms of any size or shape, for simplicity of illustration, an exemplary embodiment having four tiered platforms of a quadrilateral shape will be discussed as an illustrative and non-limiting example. As shown, a plurality of beverage container placement markers 15 are present on a top surface of the tiered platforms. The beverage container placement markers 15 may be flush with the top surface of the tiered platform or may comprise a disk or other recessed structure having a raised lip around the edge to facilitate proper placement and prevent tipping of a beverage container 22 when placed on or in the beverage container placement marker 15. While this disclosure is intended to cover any shape of beverage container placement marker 15, a round shape may be preferable to match the typical footprint of a standard beverage container 22 such as a cup, glass, or other drinking receptacle.

Figure 2:
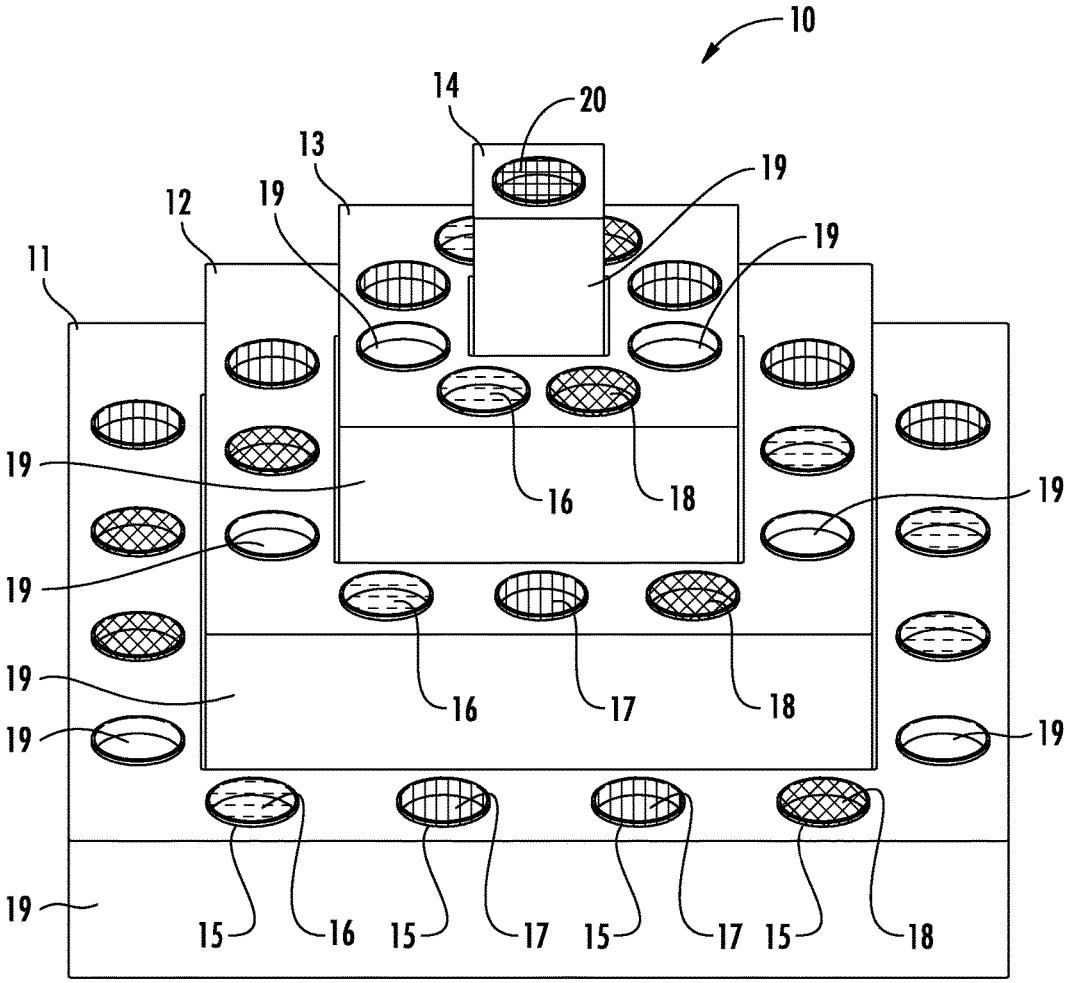
FIGS. 2-5 provide perspective views of four sides of an implementation of a beverage pong game system comprising quadrilateral tiered platforms and an exemplary color coding scheme.
Figure 3:
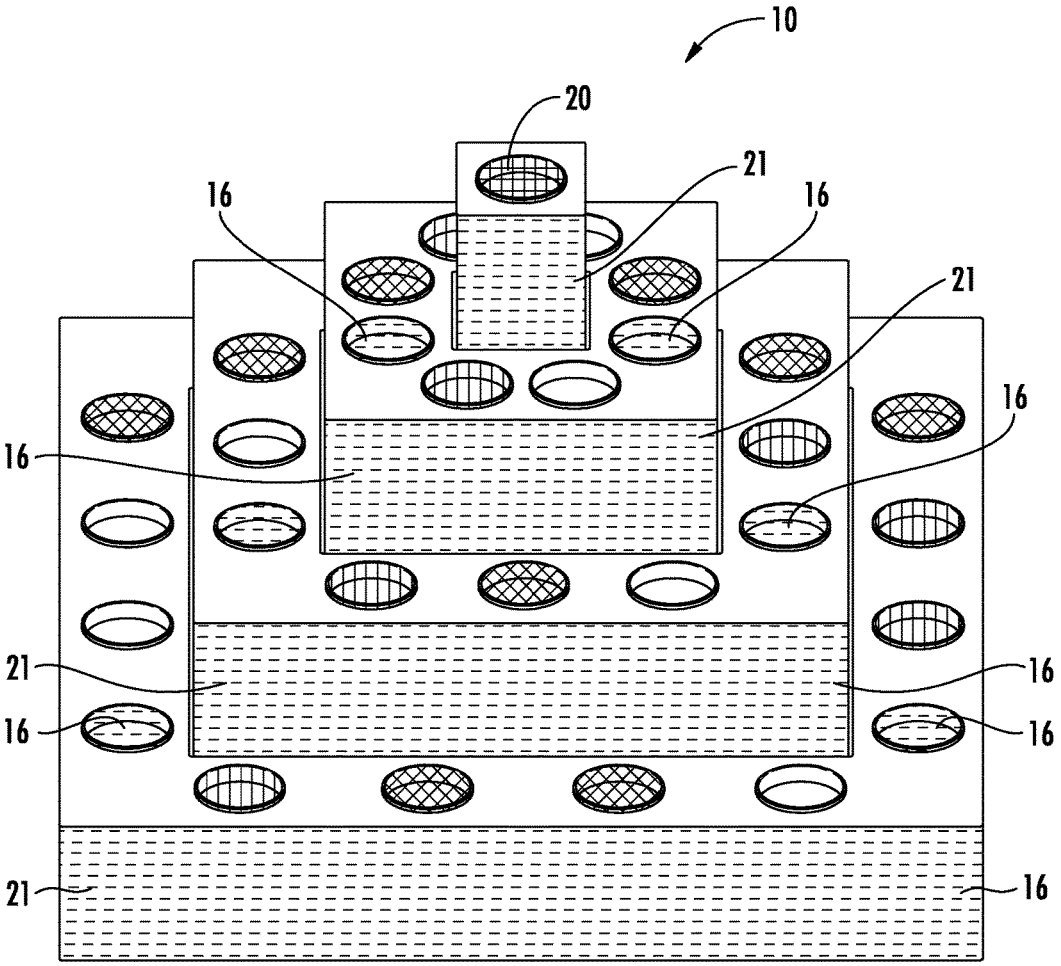
Figure 4:
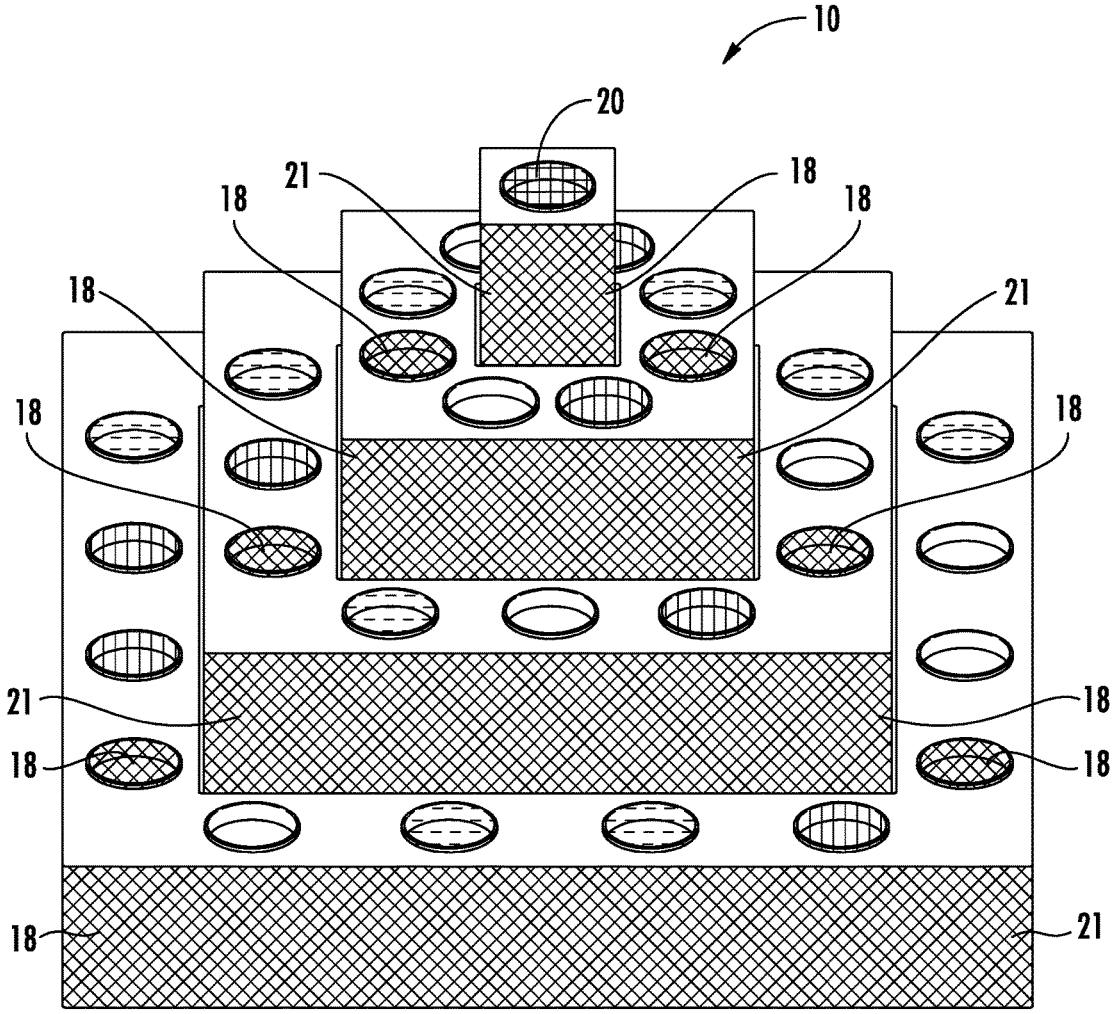
Figure 5:
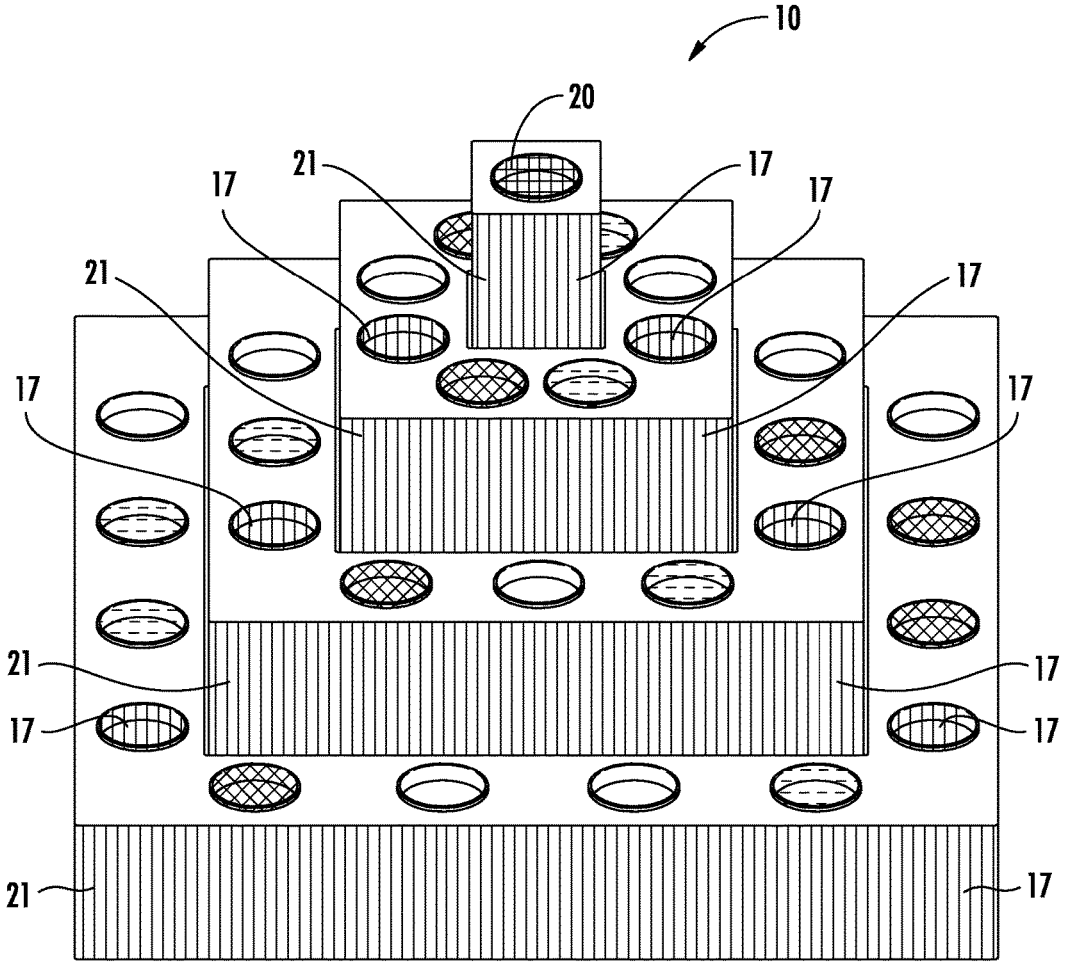

FIGS. 2-5 provide respective views of all four sides of a quadrilateral tiered platform structure comprising an exemplary color scheme that is designed to facilitate use of the tiered beverage pong system for entertainment while engaging in a game in accordance with one or more rule sets. In some embodiments, rather than colors, symbols, teams, mascots, or other insignia that relates beverage containers placement markers 15 with a vertical side wall 21 of a tiered platform may also be used which may be interchangeable to facilitate the ability to attach beverage container placement markers 15 and vertical side wall 21 overlays to fit player interests or occasions. In this exemplary embodiment which comprises a lowest tiered platform 11, a second lowest tiered platform 12, a third lowest tiered platform 13, and a highest tiered platform 14, each tiered platform may comprise a different number of beverage container placement markers 15 in accordance with the width and length of the respective tiered platform. As shown, the leftmost beverage container placement marker 15 on the lowest tiered platform 11 comprises a first color 16. Two middle beverage container placement markers 15 on the lowest tiered platform 11 comprise a second color 17 and the rightmost beverage container placement marker 15 comprises a third color 18. Moving to higher tiers, in this embodiment, the second lowest tier 12 has a leftmost beverage container placement marker 15 comprising the first color 16, a middle beverage container placement marker 15 comprising the second color 17, and a rightmost beverage container placement marker 15 comprising the third color 18. The third lowest tiered platform 13 comprises a beverage container placement marker 15 to the left having the first color 16 and a beverage container placement marker 15 to the right having the third color 18. The colors of the beverage container placement marker 15 are used to indicate the direction in which a beverage container 22 that sits upon the beverage container placement marker 15 will be passed to another player during use of the tiered beverage pong game system 10 to play a game. A fourth color 19 is present on the vertical side wall 21 of the first side of the tiered platforms as shown in FIG. 2 and this fourth color 19 is not present among the beverage container placement markers 15 that are aligned along the first side of the tiered platform structure. The highest tiered platform 14 as shown in this embodiment comprises only a single beverage container placement marker 15 which comprises a fifth color 20. FIGS. 3-5 depict second, third, and fourth sides of the tiered platform structure respectively, each of which uses a first 16, second 17, or third 18 color on the respective vertical side walls 21 of the tiered platforms that is not found among the colors of the beverage container placement markers 15 present on the same side of the platform. In some embodiments, rather than colors, symbols, teams, mascots, or other insignia that relate beverage containers placement markers 15 with a horizontal 24 or vertical side wall 21 of a tiered platform may also be used and may be interchangeable to facilitate the ability to attach beverage container placement markers 15 and horizontal 24 or vertical side wall 21 overlays to fit player interests or occasions.

Figure 6:
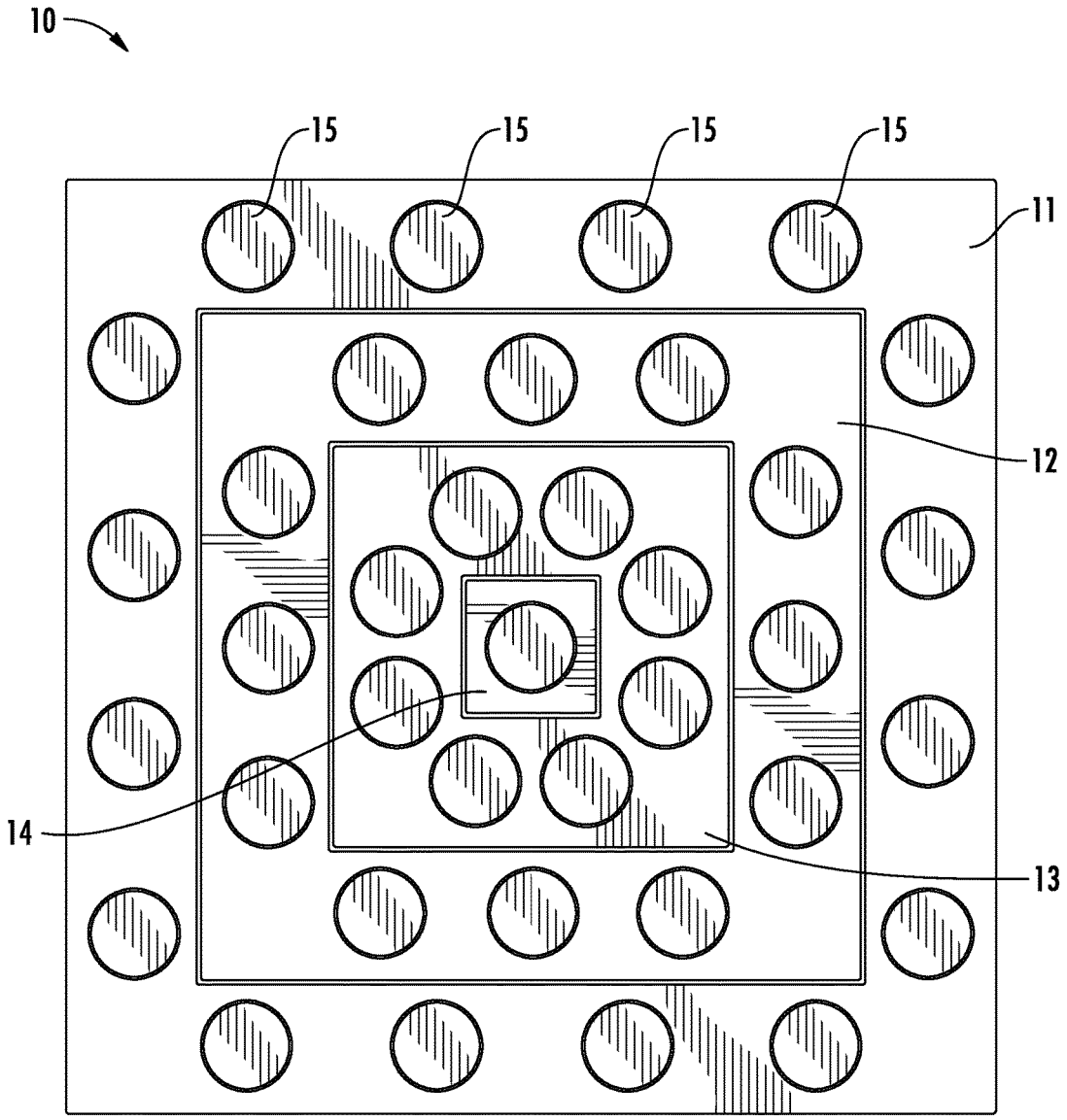
FIG. 6 provides a top view of an implementation of a beverage pong game system.

FIG. 6 provides a top view of an exemplary configuration of beverage container placement markers 15 on the plurality of tiered platforms. To play a game by using the tiered beverage pong game system 10, the tiered platform structure may be placed on a table, floor, or other appropriate surface which is conducive to bounce a ping pong or other ball off of. A beverage container 22 is placed on each beverage container placement marker 15 as shown in FIG. 1 and at least partially filled with a beverage which may be alcoholic or non-alcoholic in nature. In one embodiment, the beverage containers 22 on the three lower tiered platforms 11, 12, 13 may be filled to approximately one quarter of the capacity of the beverage container 22 and the beverage container 22 on the highest tiered platform 14 may be filled to a higher level such as for example, to half of the capacity of the beverage container 22, however any appropriate fill level may be used for any of the beverage containers 22. All beverage containers 22 may contain the same type of beverage or the beverage containers 22 may contain different beverages depending upon player preferences. In accordance with one set of exemplary rules, a player or team of players is associated with each side of the quadrilateral tiered platform structure and a minimum of four players is needed to engage in use of the game system.

To determine which player will have the first turn in the game, a player associated with each side of the tiered platform structure bounces a ping pong ball or other ball of appropriate size and weight on a surface on which the tiered platform structure rests with a goal of having the ball bounce into a beverage container 22 at the highest possible platform level. Whichever player's ball lands in a beverage container 22 at a platform level higher than that at which the other players' balls landed is awarded the first turn and becomes the first player to begin the game. During this initial step to determine which player gets to take the first turn, the players may bounce their balls one at a time or all of the players may bounce their balls simultaneously in response to a chant indicting the time at which the balls are to be released such as for example "one, two, three, Kong Pong" after which the balls are released. If multiple players' balls land within a beverage container 22 on the same tiered platform, this process can be repeated until there is an individual player having a ball that has landed in a beverage container 22 at a higher platform level that that of the other players. This player becomes the first player to take a turn and bounces the ball from the surface on which the tiered platform structure rests in an attempt to land the ball into one of the beverage containers 22 on the first player's side of the tiered platform structure.

The first player bounces the ball with the goal of the ball landing in one of the beverage containers 22 on the first player's side of the tiered platform. If this is successfully accomplished, the first player passes the beverage container 22 that the ball landed in to another player in accordance with the color or other symbol associated with the beverage container placement marker 15 that the beverage container 22 is located upon. FIG. 1 depicts the direction in which the beverage containers 22 are passed according to an exemplary embodiment of the game rules. For example, the beverage containers 22 on the left side of the first player's side of the tiered platform structure may be passed to the player whose side of the tiered platform structure is to the left of the first player, the beverage containers 22 on the right side of the first player's side of the tiered platform structure may be passed to the player whose side of the tiered platform structure is to the right of the first player, and the beverage containers 22 in the middle of the first player's side of the tiered platform structure may be passed to the player whose side of the tiered platform structure is across from the first player in accordance with matching the colors, symbols, or other insignia of the beverage container placement marker 15 with the same color, symbol, or other insignia on the vertical 21 or horizontal side wall 24 of the tiered platforms to which the beverage container 22 is passed. This is merely an example and the beverage containers may be passed in any other direction that corresponds to an association between the beverage container placement markers 15 and the vertical side walls 21 of the tiered platforms on a player's side of the tiered platform structure. The player who receives the beverage container 22 from the first player then consumes the beverage therein. The beverage container is then removed from the tiered platform leaving the beverage container placement marker from which it was removed empty.

However, if the first player's ball lands in a beverage container 22 that is on another player's side of the tiered platform structure, the first player then consumes the beverage therein and removes the beverage container 22 from the tiered platform leaving the beverage container placement marker 15 from which it was removed empty. If the ball lands in the beverage container 22 located on the highest tiered platform 14, the first player then chooses which other player the beverage container 22 is passed to for consumption of the beverage.

If the first player is unsuccessful in landing the ball into a beverage container 22, the first player may try as many times as necessary to do so or may forfeit the first players turn after one or any other predetermined number of unsuccessful bounces. Play continues by repeating this process and moving in a clockwise or counterclockwise manner or by having the player who consumed the beverage be the next player to take a turn. A winner is determined when a player or team has cleared all of the beverage containers 22 from that player or team's side of the tiered platform structure and has also cleared the beverage container from the highest tiered platform 14.

Figure 8:
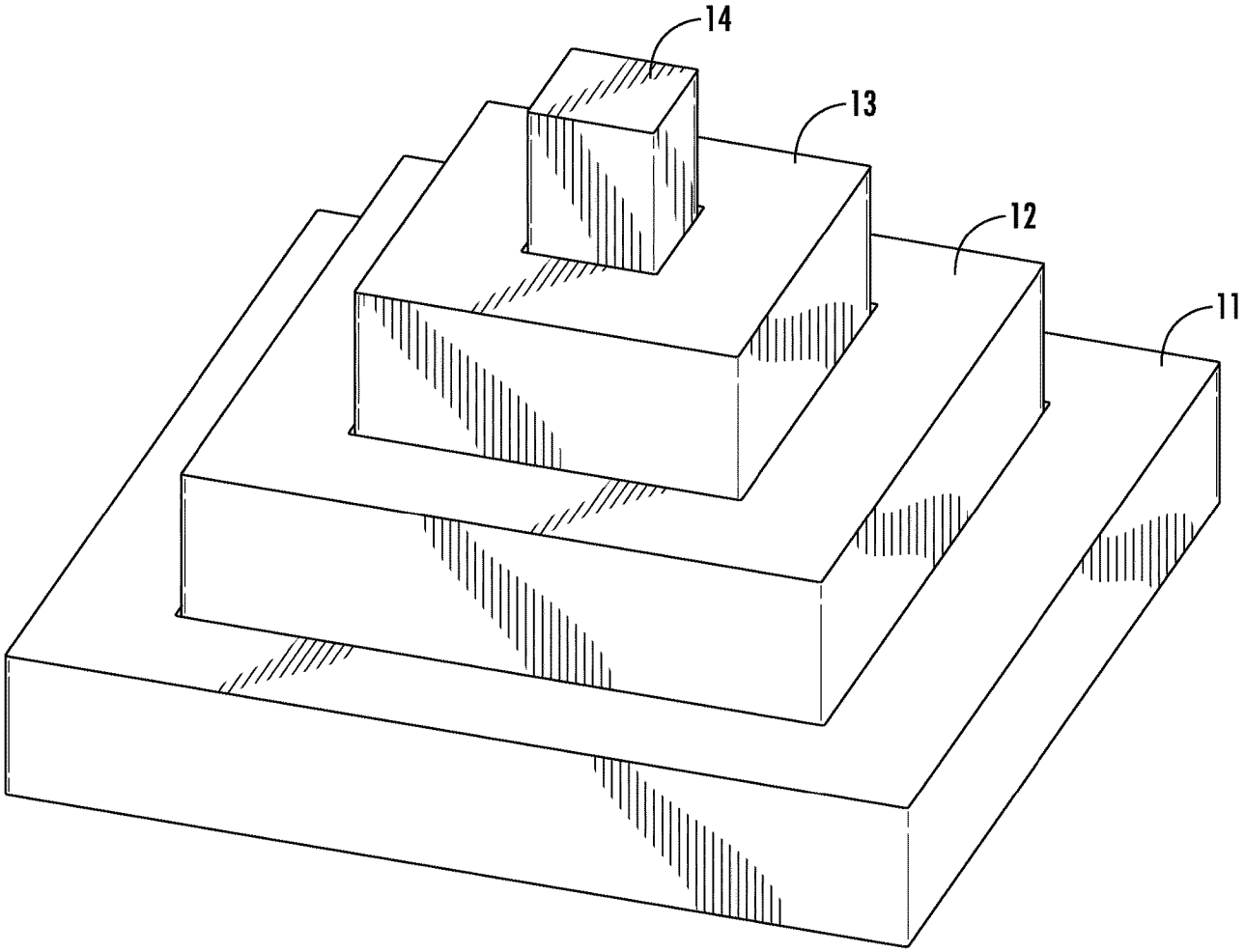
FIG. 8 provides a perspective view of an implementation of a tiered platform structure.

In an alternative embodiment, the tiered platform structure may or may not have beverage container placement markers 15 and/or color or symbol coding associated with the vertical side walls 21 of the tiered platforms. In one aspect, the tiered platforms may comprise a substantially smooth, unmarked surface as depicted in FIG. 8, however, it is contemplated that one of more beverage container placement markers may also be used on any of the tiered platforms.

Figure 9:
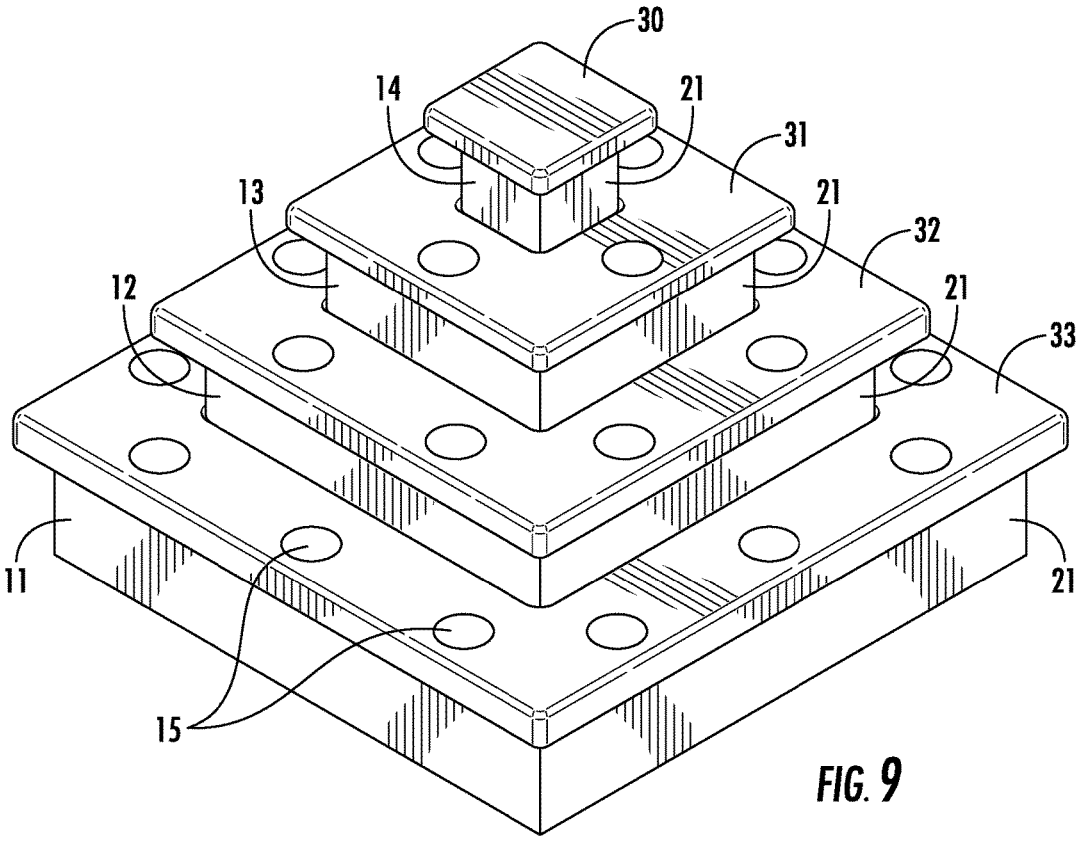
FIG. 9 provides a perspective view of an implementation of a convertible tiered game system.
Figure 10:
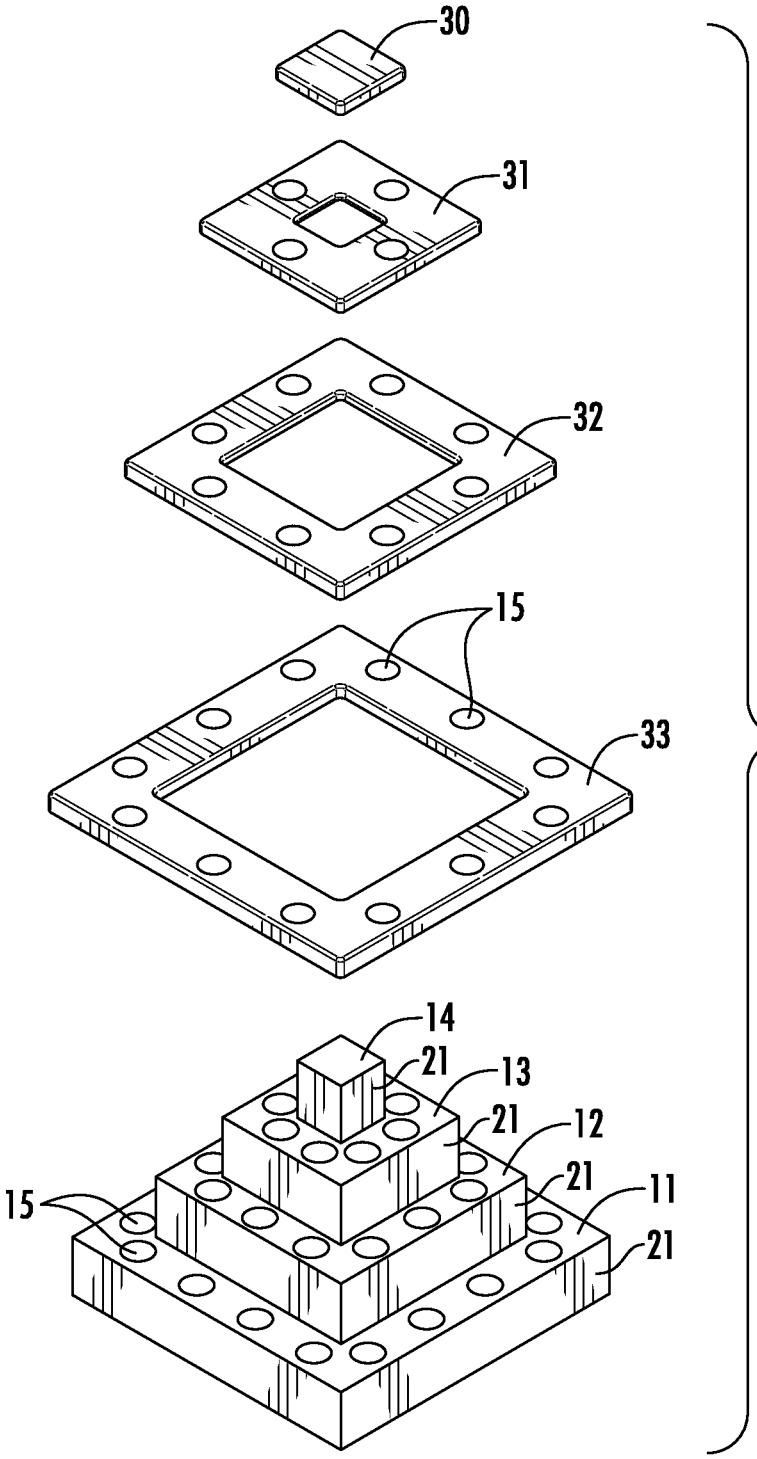
FIG. 10 provides an exploded view of an implementation of a convertible tiered game system.
Figure 11:
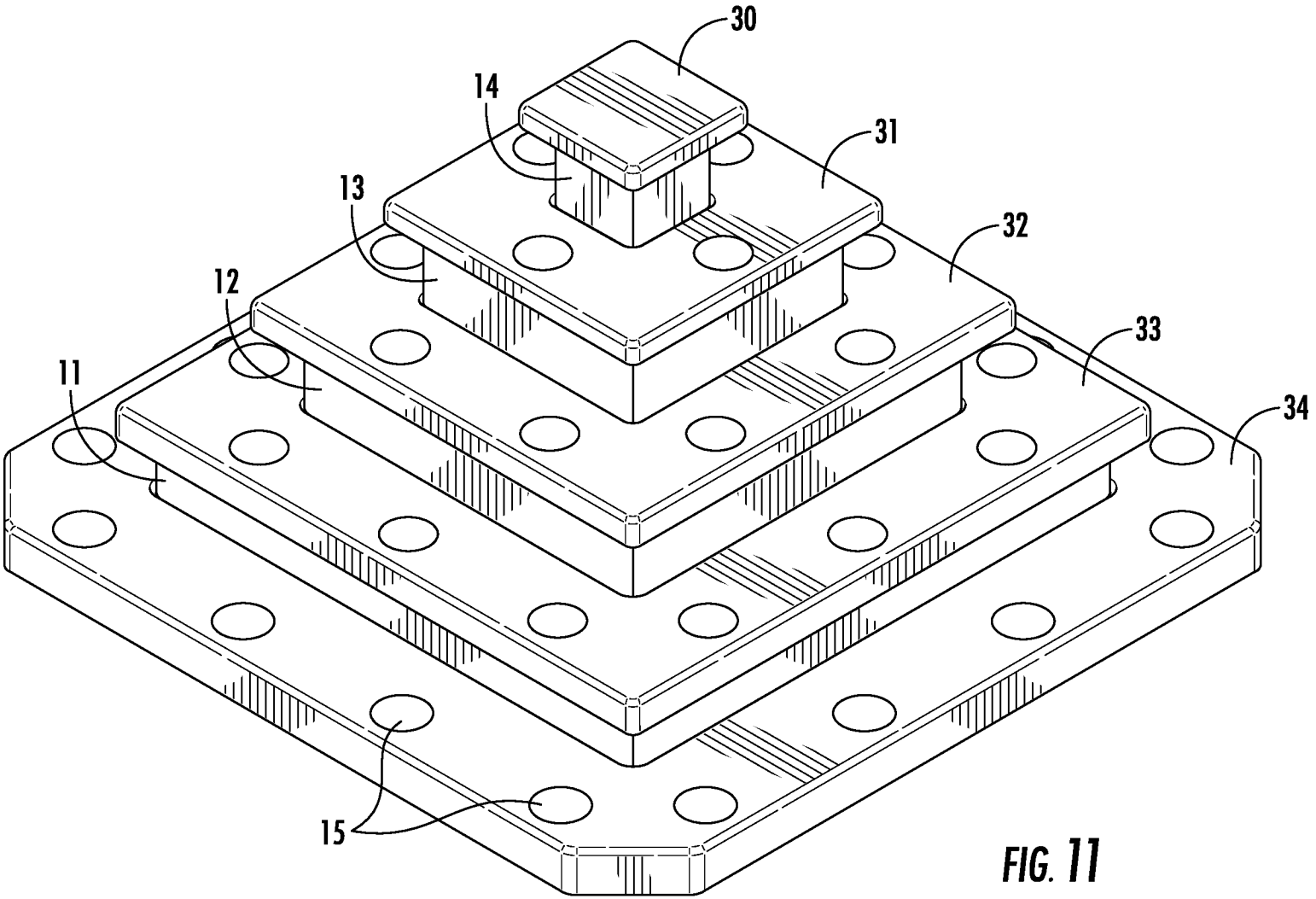
FIG. 11 provides a perspective view of an alternative embodiment of a convertible tiered game system.
Figure 12:
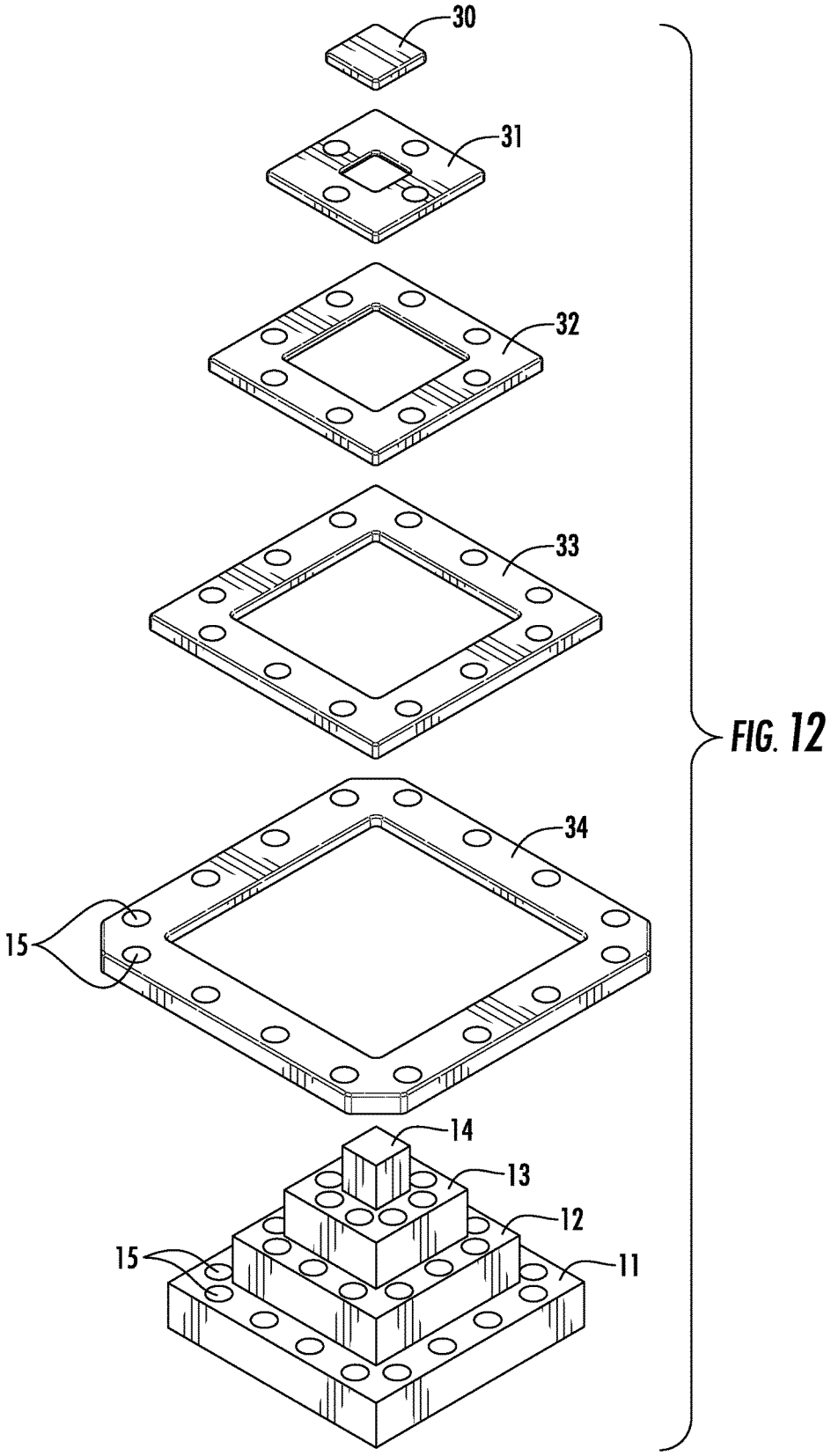
FIG. 12 provides an exploded view of an alternative embodiment of a convertible tiered game system.

As shown in FIGS. 9-11, in some embodiments, the tiered platform structure may be a component of a convertible tiered game system. One or more tiered overlays 30, 31, 32, 33 may be placed on top of the tiered platforms 14, 13, 12, 11 and seated thereon to convert the tiered platform game system to an additional game board structure with different options for rules and game play. As can readily observed in FIG. 10, in some embodiments, at least three of the tiered overlays comprise a center opening that is configured to allow a tiered platform to pass therethrough. For example, the second highest tiered overlay 31 has a center opening configured to allow the highest tiered platform 14 to pass therethrough such that the second highest tiered overlay 31 seats upon the third lowest tiered platform 13. The third highest tiered overlay 32 has a center opening configured to allow the third lowest tiered platform 13 to pass therethrough such that the third highest tired overlay 32 seats upon the second lowest tiered platform 12. Similarly, the fourth highest tiered overlay 33 comprises a center opening configured to allow the third highest tiered platform 12 to pass therethrough such that the fourth highest tiered overlay 33 seats upon the lowest tiered platform 11. The highest tiered platform 30 may comprise a substantially continuous planar upper surface that seats on the highest tiered platform 14.

For ease of assembly, it may be advantageous to start working from the bottom by placing the lowest tiered platform 11 on a substantially planar surface on which the game system is intended to rest during play. The fourth highest tiered overlay 33 may then be seated upon the lowest tiered platform 11 and tiered platforms and overlays may be added working upward until the entire game system is assembled.

As shown in FIGS. 11-14, some embodiments of a convertible tiered game system may comprise a fifth highest tiered overlay 34 comprising a center opening that is configured to allow a lowest tiered platform 11 to pass therethrough and rest on the substantially planar surface on which the lowest tiered platform 11 also rests. It should be noted that this disclosure is not intended to limit the number of tiered overlays to four or five or the number of tiered platforms to four as it is contemplated by this disclosure that any number of tiered platforms or overlays may be used to construct a tiered game system in a similar manner to what is provided by this disclosure.

Figure 13:
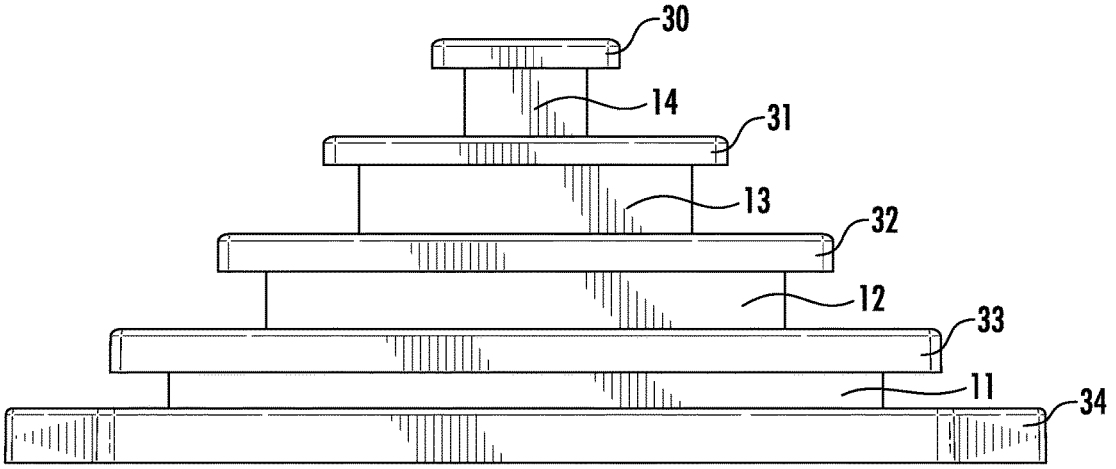
FIG. 13 provides a side elevational view of the embodiment of a convertible tiered game system of FIGS. 11-12.
Figure 14:
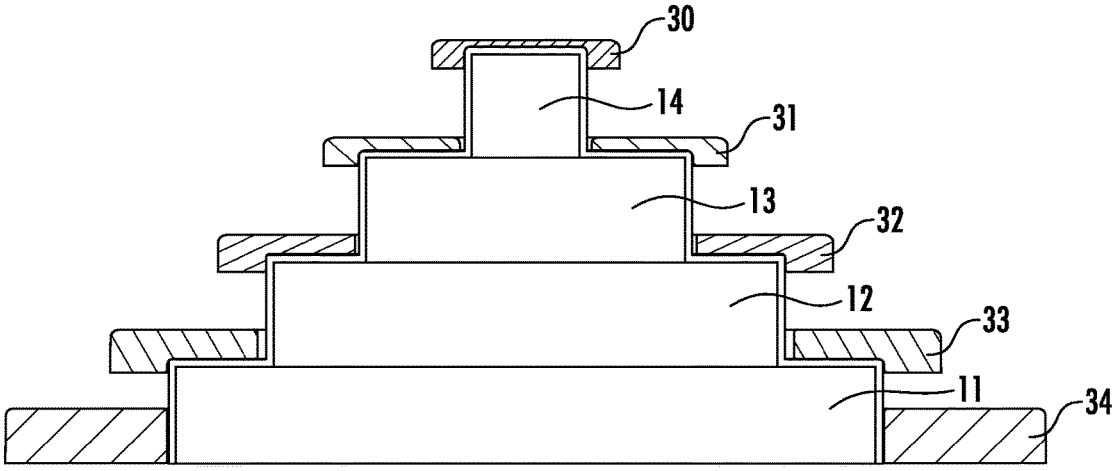
FIG. 14 provides a cross-sectional view of the convertible tiered game system of FIG. 13.

As shown in FIG. 14 which provides a cross-sectional view of the convertible tiered game system of FIG. 13, one or more of the tiered overlays that is configured to seat on a tiered platform may comprise a lip 35 proximal to a perimeter of the tiered overlay that extends downward along a vertical side wall 21 of the tiered platform upon which the tiered overlay is seated. This lip may aid in stabilizing the tiered overlay in place on the tiered platform when the game is in use.

The tiered overlays may comprise one or more beverage container placement markers 15 which may be substantially flat markings on the tiered overlays or they may be raised or recessed. The beverage markers may comprise one or more colors, logos, or other insignia which may or may not correspond to a color, logo, or other insignia on the vertical side wall 21 of one or more tiered platforms.

Figure 15A:
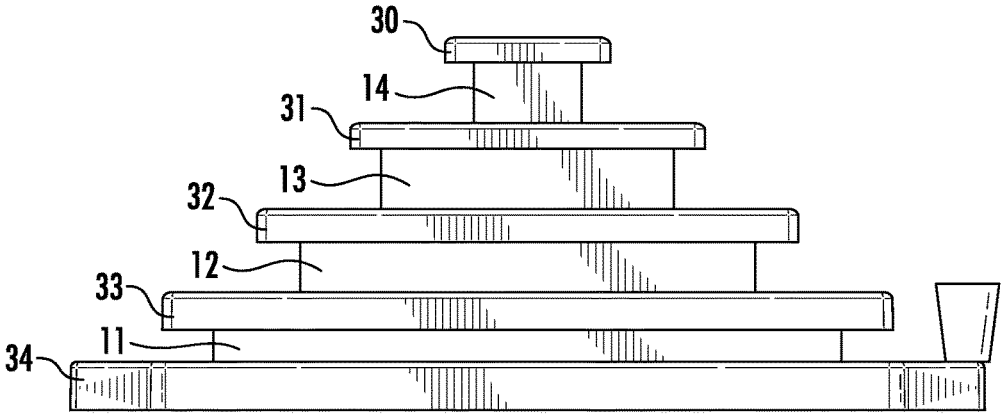
FIGS. 15A-C provide an exemplary method of flipping a beverage container in accordance with an embodiment of a method of use of a convertible tiered game system.
Figure 15B:
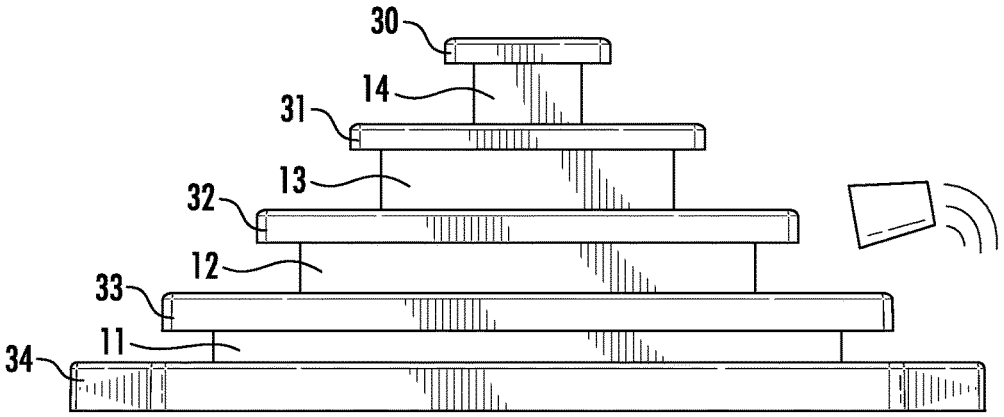
Figure 15C:
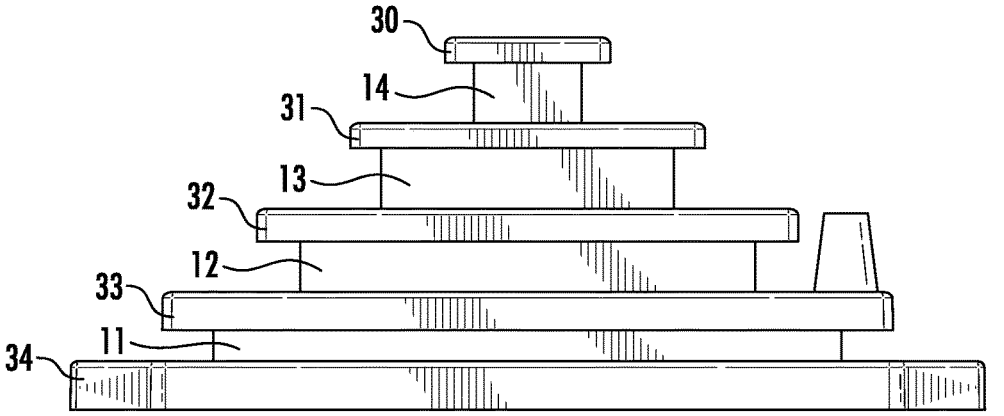

To use some embodiments of the game system, beverage containers 22 are placed on each tiered platform or tiered overlay other than the highest tiered platform 14 or tiered overlay 30 and filled at least partially with a beverage. A determination is made using any appropriate methodology to determine which player is the first to take a turn. The first player then consumes the beverage within a beverage container 22 on the lowest tiered platform 11 or lowest tiered overlay 34 and places the empty beverage container 22 back onto the lowest tiered platform 11 or the lowest tiered overlay 34 with a portion of the beverage container 22 extending over the outer edge of the lowest tiered platform or overlay, an example of which is shown in FIG. 15A. The player then attempts to flip the empty beverage container 22 up onto the second lowest tiered platform 12 or tiered overlay 33 by applying pressure with to the edge of the beverage container such that the beverage container 22 lands upside down as shown in the examples provided by FIGS. 15B-C. If the first player is unsuccessful, the beverage container 22 is returned to the lowest tiered platform 11 or lowest tiered overlay 34 and play continues to the next player. If the first player is successful, the beverage container 22 is removed from the tiered platform structure and the first player consumes a beverage from a second beverage container 22 on the lowest tiered platform 11 or lowest tiered overlay 34 and attempts to flip that beverage container 22 to the second lowest tiered platform 12 or tiered overlay 33. Anytime a beverage container 22 is successfully flipped to a higher tiered platform or overlay and lands upside down, the beverage container 22 is removed. A player continues to play as long as the player continues to successfully flip the beverage containers 22 to the next highest tiered platform or overlay. When a player's tiered platforms or overlays are cleared of all beverage containers 22 and the player is the first to successfully flip the player's last beverage container 22 to the highest tiered platform 14, that player is deemed the winner. The non-winning players then may consume the beverages in the beverage containers 22 on their respective sides of the tiered platform structure or convertible tiered game system.

Alternatively, in another embodiment, all players may start simultaneously in response to reciting a chant or phrase such as by non-limiting example, "one, two, three, Flip Kong" after which all players drink the beverage from within a beverage container 22 on the lowest tiered platform 11 or tiered overlay 34 on the players' respective sides of the tiered platform structure or convertible tiered game system and then attempt to flip the beverage container 22 to the second lowest tiered platform 12 or overlay 33 and continue in accordance with the rules above, however, in the event of an unsuccessful flip, the player continues to attempt to flip the beverage container 22 until success is achieved after replacing the beverage container 22 on the original tiered platform on which it was positioned.

While the beverage containers 22 may be flipped in accordance with any appropriate methodology, to enhance the competitiveness of the game, flipping technique may be limited to the use of one or any other predetermined number of fingers or digits.

Figure 16:
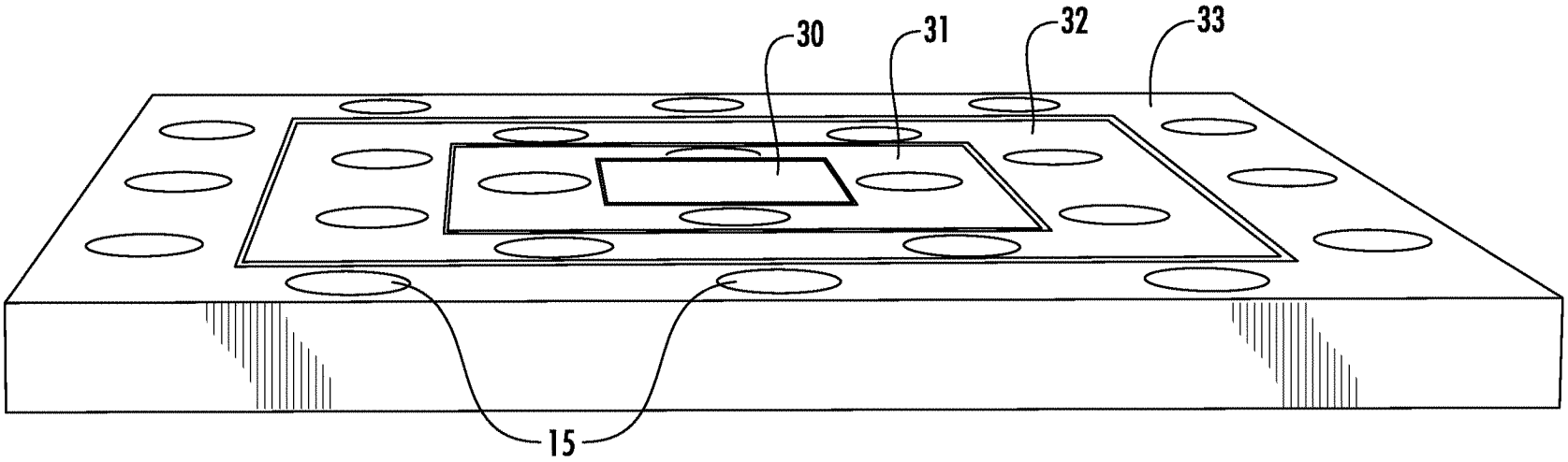
FIG. 16 provides an example of a tiered platform structure in a collapsed position.

In some embodiments, the tiered platform structure or convertible tiered game system may be collapsible and reversible so that two versions of a game having different rules may be played using the same tiered platform structure or convertible tiered game system in a different configuration. In some aspects, each tiered platform except for a highest tiered platform may comprise a central opening configured such that each next lower tiered platform may be placed on top of each next higher tiered platform to create a collapsed and nested tiered platform structure having a vertical height that is substantially equal to a height of a vertical side wall of a lowest tiered platform as shown in FIG. 16. This may be advantageous for the purposes of storage or shipment of the game system.

While it is contemplated that either the tiered platform structure or the convertible tiered game system may be used by player in accordance with any of the sets of game rules described herein and with any number of beverage container placement markers 15 on any of the tiered platforms or overlays, in some embodiments, as shown in FIGS. 9-12, the highest tiered overlay may lack any beverage container placement markers and each next lowest tiered overlay may comprise one additional beverage container placement marker 15 along each player's side of the tiered overlay than the tiered overlay directly above it. For example, the lowest tiered overlay comprises a highest number of beverage container placement markers along each side of the lowest tiered overlay and each higher overlay comprises one fewer beverage container placement marker than the tiered overlay directly below it. While the tiered overlays and tiered platforms are shown here as having a substantially square shape, it is also contemplated that the tiered platforms and tiered overlays may comprise any appropriate shape suitable for game play.

Figure 17:
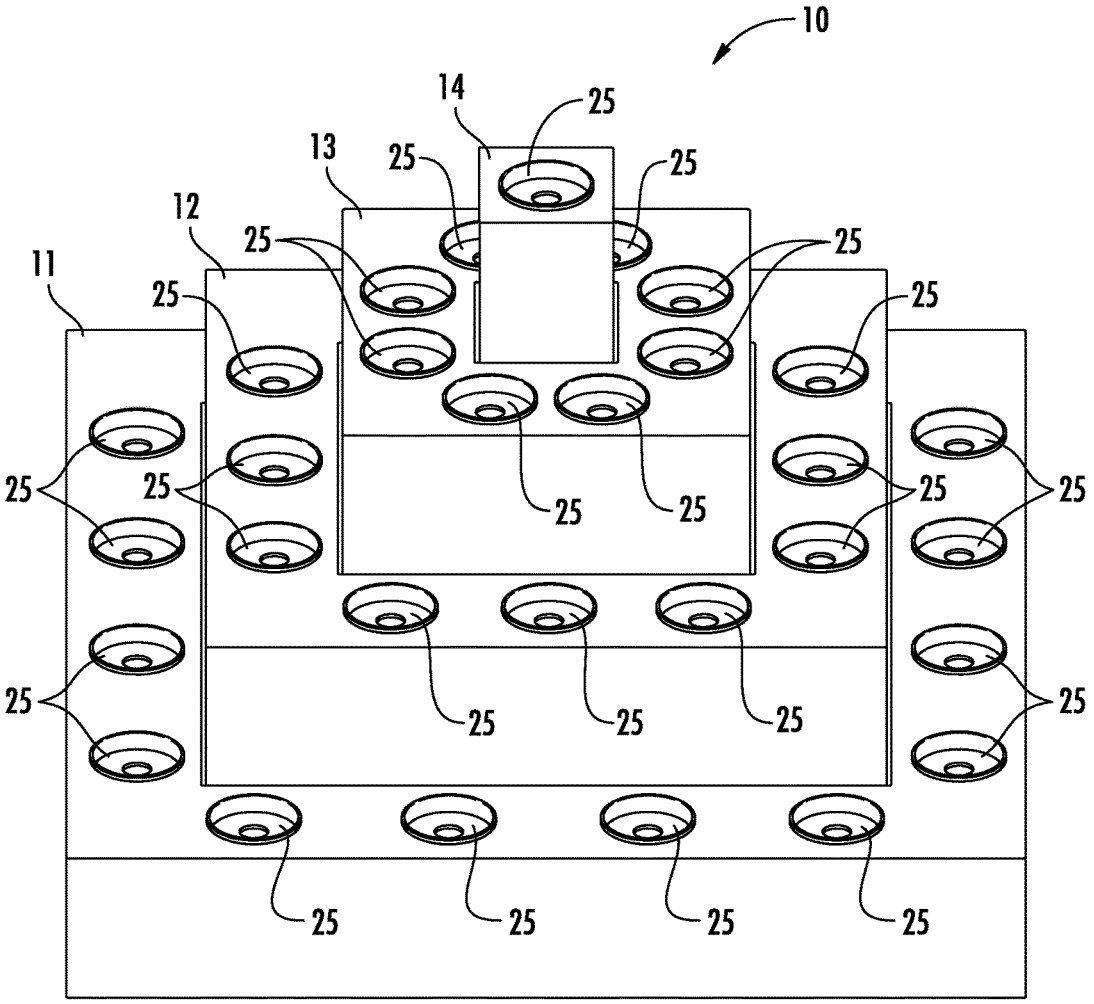
FIG. 17 provides an exemplary embodiment of a tiered platform structure having removable beverage container placement markers.
Figure 18:
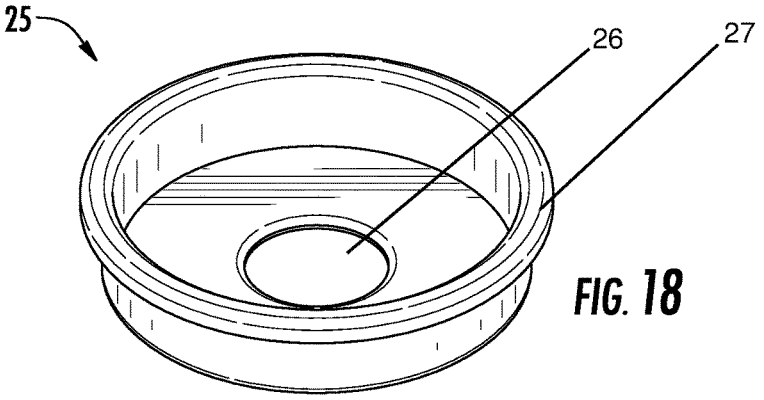
FIG. 18 provides an example of an embodiment of a removable beverage container placement marker.
Figure 19:
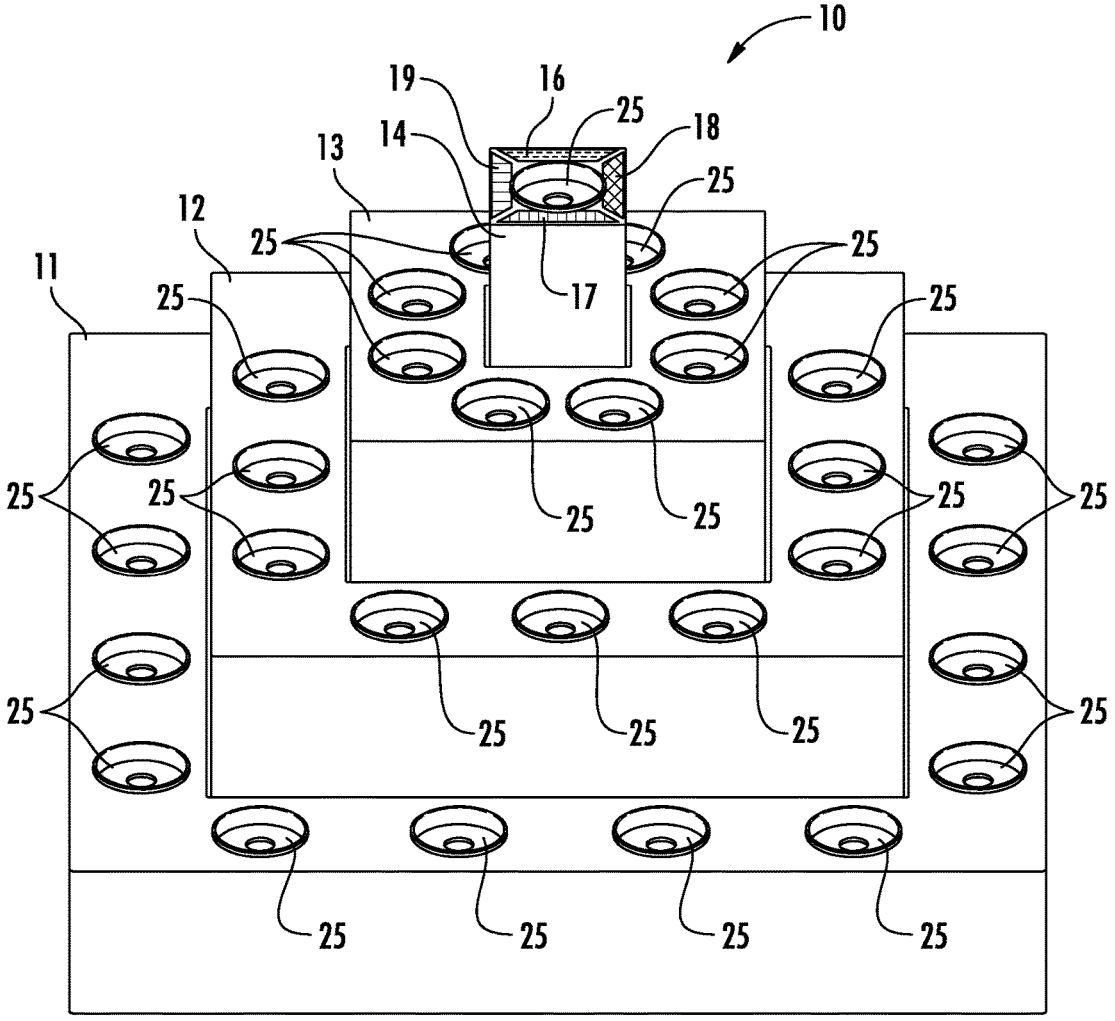
FIG. 19 provides an exemplary embodiment of a tiered platform structure having color coding on a highest tier.

In some implementations, the tiered platform structure 10 may comprise removable beverage container placement markers 25 as shown in FIGS. 17-19. While the removable beverage container placement markers 25 may comprise any shape, in some embodiments, the removable beverage container placement markers 25 may have a round shape with a depression that allows a beverage container to sit slightly below the surface of the tiered platform on which the removable beverage container placement marker 25 sits. In some embodiments, the removable beverage container placement marker 25 may comprise a ridge 27 on the upper perimeter to prevent the removable beverage container placement marker 25 from slipping through the cutout in the tiered platform in which it is intended to rest. To aid in removing the removable beverage container placement markers 25 from the tiered platform structure 10, the removable beverage container placement markers 25 may comprise an opening 26 in the bottom surface of the depressed region of the removable beverage container placement markers 25 such that a user may insert a digit to easily remove that removable beverage container placement markers 25 from the tiered platform surface.

As shown in FIG. 19, in some embodiments of a tiered platform structure 10, vertical side walls 21 of the tiered platforms and tiered platform surfaces may not have colors or other insignia on them to indicate to which player should consume which beverage. Alternatively, a highest tier 14 may comprise color coding 16, 17, 18, 19 along each side of the top surface of the highest tiered platform 14 which indicates which player is associated with which color 16, 17, 18, 19. FIG. 19 depicts this color coding as bars or other geometric shapes of color, but this disclosure also contemplates that logos or other shapes indicating a color or other insignia may also be used to indicate which player or team of players is to consume which beverage.

Figure 7:
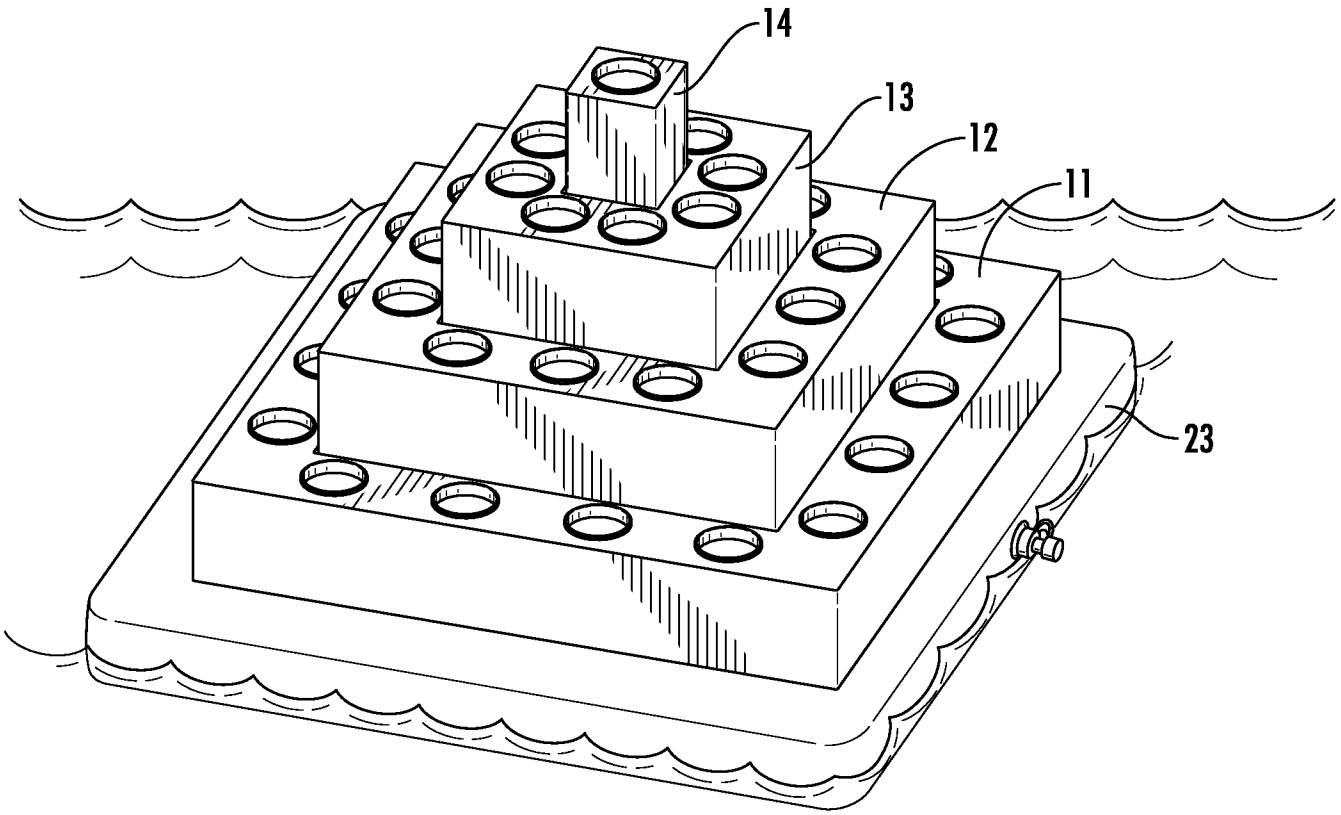
FIG. 7 provides a perspective view of an implementation of a beverage pong game system coupled to a flotation device.

In other embodiments, as shown in FIG. 7, the tiered platform structure or convertible tiered game system may be coupled to a flotation device 23 for use for aquatic entertainment.

In places where the description above refers to particular implementations a tiered beverage pong game system, it should be readily apparent that a number of modifications may be made without departing from the spirit thereof and that these implementations may be applied to other to systems and techniques for convertible tiered game systems.

What is claimed is:

1. A convertible tiered game system comprising:

a plurality of tiered platforms, each tiered platform having at least one of a width and a length that is greater than any higher tiered platform;

a plurality of tiered overlays configured to be seated upon each tiered platform among the plurality of tiered platforms, at least three of the tiered overlays comprising a center opening that is configured such that a next highest tiered platform is allowed to pass through the center opening and having at least one of a width and a length that is greater than any higher tiered overlay, wherein the at least three tiered overlays comprise a width that is greater than a width of the tiered platform on which the tiered overlay is seated and a length that is greater than a length of the tiered platform on which the overlay is seated; and a plurality of beverage container placement markers located on at least one of a tiered platform and a tiered overlay.

2. The convertible tiered game system of claim 1, further comprising a lowest tiered overlay comprising a center opening configured to pass a lowest tiered platform therethrough.

3. The convertible tiered game system of claim 2, wherein the lowest tiered overlay is configured to rest on a surface on which the lowest tiered platform rests.

4. The convertible tiered game system of claim 1, further comprising a highest tiered overlay configured to be seated upon a highest tiered platform.

5. The convertible tiered game system of claim 1, wherein at least one tiered overlay among the plurality of tiered overlays comprises a lip that overhangs a vertical side of the tiered platform on which the at least one tiered overlay is seated.

6. The convertible tiered game system of claim 1, wherein each tiered overlay that comprises an opening comprises a plurality of beverage container placement markers.

7. The convertible tiered game system of claim 1, wherein each tiered overlay comprising an opening comprises one more beverage container placement marker along a width of a lower tiered overlay than the tiered overlay comprising an opening immediately above the lower tiered overlay.

8. The convertible tiered game system of claim 1, wherein each tiered platform except for a highest tiered platform comprises a central opening configured such that each next lower tiered platform may be placed on top of each next higher tiered platform to create a collapsed and nested tiered platform structure having a vertical height that is substantially equal to a height of a vertical side wall of a lowest tiered platform.

9. A convertible tiered game system comprising:

a plurality of tiered platforms, each tiered platform having at least one of a width and a length that is greater than any higher tiered platform;

a plurality of tiered overlays each having at least one of a width and a length that is greater than any higher tiered overlay, each tiered overlay configured to be seated upon a tiered platform, the plurality of tiered overlays comprising:

at least three tiered overlays comprising a center opening; and a highest tiered overlay comprising a continuous substantially planar surface;

wherein each tiered overlay has at least one of a width and a length that is greater than any higher tiered overlay and each tiered overlay is configured to be seated upon a tiered platform, wherein each tiered overlay comprises a lip proximal to a perimeter of the tiered overlay that extends downward along a vertical side of the tiered platform upon which the tiered overlay is seated.

10. The convertible tiered game system of claim 9, wherein the plurality of tiered overlays further comprises a lowest tiered overlay comprising a center opening configured to allow a lowest tiered platform to pass therethrough.

11. The convertible tiered game system of claim 9, further comprising a plurality of beverage container placement markers located on an upper surface of at least one tiered overlay.

12. The convertible tiered game system of claim 11, wherein:

a second highest tiered overlay comprises a single beverage container placement marker on an upper surface of each of four sides of the second highest tiered overlay;

a third highest tiered overlay comprises two beverage container placement markers on an upper surface of each of four sides of the third highest tiered overlay; and a fourth highest tiered overlay comprises three beverage container placement markers on an upper surface of each of four sides of the fourth highest tiered overlay.

13. The convertible tiered game system of claim 12, further comprising a fifth highest tiered overlay comprising four beverage container placement markers on an upper surface of each of four sides of the fifth highest tiered overlay.

* * * * *